US008004102B2

(12) United States Patent
Rauch et al.

(10) Patent No.: US 8,004,102 B2
(45) Date of Patent: Aug. 23, 2011

(54) REFRIGERATION GENERATION METHOD AND SYSTEM

(75) Inventors: Jeremiah James Rauch, Clarence Center, NY (US); Robert Leroy Baker, Williamsville, NY (US); Gerald T. O'Connor, West Seneca, NY (US); Michael John Stanko, Grand Island, NY (US); Murali Chinta, Toledo, OH (US)

(73) Assignee: Praxair Technology, Inc., Danbury, CT (US)

( * ) Notice: Subject to any disclaimer, the term of this patent is extended or adjusted under 35 U.S.C. 154(b) by 386 days.

(21) Appl. No.: 12/418,056

(22) Filed: Apr. 3, 2009

(65) Prior Publication Data

US 2010/0251766 A1 Oct. 7, 2010

(51) Int. Cl.
*F01D 15/10* (2006.01)

(52) U.S. Cl. ..... 290/52; 290/40 B

(58) Field of Classification Search ..... 290/52, 290/40 D, 40 E, 40 B
See application file for complete search history.

(56) References Cited

U.S. PATENT DOCUMENTS

| | | | | |
|---|---|---|---|---|
| 2,971,334 | A * | 2/1961 | Carlson | 60/791 |
| 4,362,020 | A * | 12/1982 | Meacher et al. | 60/657 |
| 4,739,180 | A * | 4/1988 | Yanoma et al. | 290/2 |
| 4,806,781 | A * | 2/1989 | Hochstetter | 290/43 |
| 4,904,158 | A | 2/1990 | Kun | |
| 4,994,684 | A * | 2/1991 | Lauw et al. | 290/52 |
| 5,285,123 | A * | 2/1994 | Kataoka et al. | 310/88 |
| 5,376,827 | A * | 12/1994 | Hines | 290/52 |
| 5,481,145 | A | 1/1996 | Canders et al. | |
| 5,659,205 | A * | 8/1997 | Weisser | 290/52 |
| 5,758,515 | A | 6/1998 | Howard | |
| 5,932,940 | A * | 8/1999 | Epstein et al. | 310/40 MM |
| 6,382,910 | B1 | 5/2002 | Kato et al. | |
| 6,441,508 | B1 | 8/2002 | Hylton | |
| 6,664,672 | B2 * | 12/2003 | Kalsi et al. | 310/57 |
| 7,077,626 | B2 | 7/2006 | Bosen | |
| 2007/0041846 | A1 | 2/2007 | Bosen | |
| 2008/0216511 | A1 | 9/2008 | Howard | |

FOREIGN PATENT DOCUMENTS

EP 1 975 375 A2 10/2008

OTHER PUBLICATIONS

Reuter, K., "Integrated System of Turboexpander with Magnetic Bearings and High Frequency Generator", Third Symp on Magnetic Bearings, 1992.

Reuter, K., "Integrated Machinery Systems for Cryogenic Processes Consisting of Turboexpander, Compressor, High-Frequency Motor and Generator with Magnetic Bearings", Proceedings of the 1997 IEE Colloquium on High Speed Bearings for Electrical Machines, IEE Colloquium Digest, No. 164, 1997.

* cited by examiner

*Primary Examiner* — Thanh Lam
(74) *Attorney, Agent, or Firm* — David M. Rosenblum

(57) ABSTRACT

The present invention provides a method and apparatus for generating refrigeration in a process operating at sub-ambient temperatures in which the refrigeration is generated by a turboexpander. The turboexpander is coupled to a generator controlled so that its speed is maintained at a setpoint through electromagnetic braking and its power output is maintained at line matching voltage and frequency. The speed control of the generator therefore, also controls the speed of the turboexpander. The setpoint is calculated to be equal to a product of an operational efficiency parameter, $U/C_o$, and a square root of twice the enthalpy drop in the flow passing through the turboexpander divided by a product of pi and a diameter of an impeller employed within the turboexpander.

10 Claims, 4 Drawing Sheets

REFRIGERATION GENERATION METHOD AND SYSTEM

FIELD OF THE INVENTION

The present invention relates to a method and apparatus for generating refrigeration in a process operating at a sub-ambient temperature in which the refrigeration is generated by a turboexpander and the work of expansion is converted to electrical power by a variable speed generator coupled to the turboexpander. More particularly, the present invention relates to such a method and system in which an auxiliary controller computes an efficient speed for the turboexpander and such efficient speed serves as an input to a speed controller associated with the variable speed generator to control the speed of the generator and therefore the turboexpander by electromagnetic braking.

BACKGROUND OF THE INVENTION

Refrigeration is generated in sub-ambient temperature apparatus such as air separation plants and liquefiers to produce the necessary sub-ambient temperatures required for the operation of such apparatus. The refrigeration is generated by expanding a compressed stream to a lower pressure with the performance of work to generate a cold exhaust stream that is used to impart the refrigeration into the apparatus. The work of expansion must be extracted from the apparatus and this is done through the generation of heat in an oil brake mechanism that dissipates outside the apparatus, through the load applied by a compressor or by an electrical generator to generate electricity that can be sold to the electrical power grid to offset power costs in running the plant.

For example, in an air separation plant air is compressed and purified to produce a compressed stream. Part of the compressed stream is introduced into a heat exchanger and is cooled to a temperature suitable for its rectification within one or more distillation columns to produce nitrogen and possibly also, oxygen and argon product streams. Where both nitrogen and oxygen product streams are desired, the compressed and purified air is introduced into a double column unit having a high pressure distillation column to separate nitrogen from the air and thereby to produce a crude liquid oxygen column bottoms also known as kettle liquid. A stream of the bottoms liquid is further refined in the low pressure column to produce an oxygen-rich liquid column bottoms from which the oxygen product is taken and a nitrogen-rich vapor column overhead. The high pressure distillation column also produces a nitrogen-rich vapor column overhead that is at least in part condensed through indirect heat exchange with the oxygen-rich liquid column bottoms in the low pressure column to produce liquid nitrogen reflux for both the high and low pressure columns. The nitrogen product is taken from the nitrogen-rich vapor produced in the low pressure column, the high pressure column or both or also, from part of the condensed nitrogen-rich liquid.

In an air separation plant, the nitrogen-rich vapor from the low pressure column and oxygen-rich liquid are introduced along with other streams into the cold end of the main heat exchanger to help cool the air and for discharge as nitrogen and oxygen products. However, in the discharge of such products there are thermal losses at the warm end of the main heat exchanger as well as heat leakage into an insulated containment known as a cold box that is used to house the distillation columns. In order to compensate for such heat leakage and thermal losses, refrigeration is generated by further compressing another part of the compressed and purified air, partly cooling such air in the main heat exchanger and then introducing the compressed and partially cooled air into a turboexpander. The turboexpander may either be coupled to the booster compressor or may be used to drive the generator. In air separation plants that are designed to produce a high pressure gaseous oxygen product, a stream of the oxygen-rich liquid from the low pressure column is pumped and such stream is warmed within the main heat exchanger to produce the gaseous oxygen product at the high pressure. In order to warm such a stream in the main heat exchanger, a yet further part of the air is further compressed and then cooled within the main heat exchanger. Such air, after cooling, can also be introduced into a turbine known as a liquid expander to generate more refrigeration. This turbine can be coupled to an electric power generator.

In a liquefier, in which a gas is liquefied, for example, an atmospheric gas or natural gas, an incoming gas stream is compressed and cooled in a heat exchanger to a liquid or a two-phase state that is separated into a vapor that is recycled and the liquid product of the plant. Part of the compressed stream is further compressed and expanded in a turboexpander or potentially a series of tuboexpanders operating at successively lower temperature levels to produce exhaust streams that are recirculated into the heat exchanger to cool the incoming gas to be liquefied. The turboexpanders can be coupled to booster compressors, oil brake mechanisms or electrical generators. There are many different cycles employed with respect to liquefiers and the foregoing generally represents one of such cycles.

In expanders used for purposes such as discussed above, the expander has a radial inflow layout in which the incoming compressed stream is directed by nozzles to an impeller that can be coupled to a generator for generating electrical power. In situations in which the turboexpander is coupled to an electrical generator, typically, an alternating current induction motor is used as the generator. As can be appreciated, in order to supply electrical power to an electrical power grid, the electricity must be generated at slightly above the voltage in the grid to drive the generated power into the grid and at the line frequency employed in the grid, for example, 60 Hertz. By using a motor as a generator that is designed to operate at 60 Hertz, the application of such technology becomes very straight forward. One problem, however, is that the motor-generator is designed to operate at a maximum nominal 3,600 rpm based upon a line frequency of 60 Hertz and the turboexpander is designed to operate at much higher speeds, typically between 20,000 and 40,000 rpm. Hence, a complex geared transmission must be used that inherently will produce irreversible losses as heat between the turboexpander and the generator. Additionally, since the generator speed is constrained at 3,600 rpm, the turboexpander's speed is also constrained. Any turbomachinery has a specific isentropic efficiency that is related to the energy of the flow passing through such machinery and the shaft speed of the machine. More specifically, for a given turboexpander, the efficiency or in other words, the degree to which energy of the flow passing through the turboexpander will be transmitted will depend on flow rate and enthalpy drop in the flow passing through the turboexpander and speed of the impeller. Consequently, the gearing between the turboexpander and the generator is designed for a normal operational speed of the turboexpander that upon such normal operating conditions of flow, pressure and temperature of the flow, the efficiency of the turboexpander will be at a maximum. However, during turndown of an air separation plant or a liquefier or other sub-ambient temperature apparatus during which the apparatus is operating at less than standard design conditions, the turboexpander is being constrained to operate in an inefficient manner in order to provide the set speed to the geared transmission connected to the generator.

Recently, high speed motors have been developed having sophisticated electronic drive units that allow the motor to operate at any speed and specifically, in speed regimes that are the same at which a turboexpander of a sub-ambient device are operated. It has been found by the inventors herein that the sophisticated electronic drives and such high speed motors in particular, can be used in refrigeration systems that are employed in sub-ambient temperature apparatus, such as have been discussed above, in a manner that will obviate the problems in the prior art outlined above.

SUMMARY OF THE INVENTION

The present invention, in one aspect, provides a method of generating refrigeration in a process operating at sub-ambient temperatures. As used herein and in the claims, the term "process" means any apparatus or system of equipment that is designed to process a process fluid, for example air, at sub-ambient temperatures by addition of refrigeration generated all or in part by a turboexpander. In accordance with the method, a process stream, utilized within the process, is compressed to produce a compressed process stream. The compressed process stream is expanded within a turboexpander having an impeller that is driven by the process stream with performance of work, thereby producing an exhaust stream. The turboexpander is designed to operate at an operational efficiency parameter equal to an optimal value of $U/C_o$. The exhaust stream is introduced to impart the refrigeration into the process. Electrical power is generated in a generator having a rotor coupled to the impeller so that the generator is driven by the work of expansion.

The speed of the rotor of the generator is controlled and therefore, the speed of the turboexpander is also controlled through electromagnetic braking of the rotor such that the speed is maintained at a setpoint and electrical current output of the generator increases as the speed of the rotor decreases and decreases as the speed of the rotor increases. It is to be noted here that as used herein and in the claims, the term, "electromagnetic braking" means the counter-torque or braking torque produced in the rotor of the generator as a consequence of the controlled current in stator coils employed in the generator. Additionally, the voltage and frequency of the electrical power generated by the generator is controlled so as to be maintained at line matching levels and the electrical power generated by the generator may be introduced into a local electrical power grid at the line matching levels.

The setpoint of the speed of the rotor is continually determined by setting the setpoint equal to the product of the operational efficiency parameter and a square root of twice the difference between enthalpies of the process stream upon entry into the turboexpander and the exhaust stream upon discharge from the turboexpander, divided by a product of pi and a diameter of the impeller.

Thus, the present invention allows the generator to set the speed of the turboexpander that is based on the enthalpy drop of the flow and the flow rate of the process fluid passing through the turboexpander to obtain an operational efficiency parameter that will produce a turboexpander operation that is always the most efficient for a given set of operational conditions. As a result, the turboexpander will be optimally efficient during normal operational conditions of the process and during turn down conditions.

The difference between enthalpies of the compressed process stream and the exhaust stream can be determined by providing enthalpy data for the compressed process stream that is based upon pressure and temperature of the compressed process stream. The enthalpies can in turn be determined by measuring a flow rate of the compressed process stream and measuring a process stream temperature and pressure of the compressed process stream and determining an inlet enthalpy from the enthalpy data, the flow rate and the compressed process stream temperature and pressure. Similarly, an exhaust stream temperature and pressure of the exhaust stream can be measured and an exhaust enthalpy of the exhaust stream can be determined from the enthalpy data, the flow rate, the exhaust stream temperature and pressure. Thereafter, it is simply a matter of subtracting the exhaust enthalpy from the inlet enthalpy.

Preferably, the flow rate is measured with a flow transducer generating a flow rate signal referable to the flow rate and the compressed process stream temperature and pressure and the exhaust stream temperature and pressure are measured with temperature sensors and pressure transducers generating temperature and pressure signals referable to the compressed process stream temperature and pressure and the exhaust stream temperature and pressure. An auxiliary controller, responsive to the flow rate signal, the temperature and pressure signals and containing the enthalpy data in a database, is configured to determine the inlet enthalpy, the exhaust enthalpy, the difference between the enthalpy of the process inlet stream and the exhaust stream and the square root of twice the difference and to divide the square root by pi multiplied by the impeller diameter for purposes of calculating the setpoint for the speed of the rotor.

In another aspect, the present invention provides a refrigeration generation system in an apparatus operating at sub-ambient temperatures. In accordance with this aspect of the present invention, a turboexpander having an impeller is driven by a process stream compressed within the apparatus such that the compressed process stream is expanded with the performance of work and an exhaust stream is thereby produced by the turboexpander. The turboexpander is designed to operate at an operational efficiency parameter equal to optimal value of $U/C_o$. The turboexpander is connected to the apparatus such that the process stream is introduced into the turboexpander and the exhaust stream is introduced into the apparatus to impart the refrigeration into the apparatus. A generator is provided to generate electrical power. The generator has a rotor coupled to the impeller so that the generator is driven by the work of expansion. A generator controller is connected to the generator and configured to control the speed of the rotor of the generator and therefore, the turboexpander through electromagnetic braking of the rotor such that the speed is maintained at a setpoint and electrical current output of the generator increases as the speed of the rotor decreases and decreases as the speed of the rotor increases. The generator controller also controls voltage and frequency of the electrical power generated by the generator such that the voltage and the frequency is maintained at line matching levels to enable the electrical power generated by the generator to be introduced into a local electrical power grid at the line matching levels.

A flow transducer is positioned upstream of the turboexpander so as to generate a flow rate signal referable to a flow rate of the compressed process stream. Additionally, an upstream pair of temperature sensors and pressure transducers positioned upstream of the turboexpander so as to generate process stream temperature and pressure signals referable to the process stream temperature and pressure of the process stream. A downstream pair of temperature and pressure transducers positioned downstream of the turboexpander so as to generate exhaust stream temperature and pressure signals referable to exhaust stream temperature and pressure of the exhaust stream. An auxiliary controller is connected to the generator controller and is responsive to the flow rate signal, the process stream and the exhaust stream temperature and pressure signals. The auxiliary controller contains enthalpy data of the process stream in a database. The auxiliary controller is programmed to continually determine an inlet enthalpy of the compressed process stream and an exhaust stream enthalpy of the exhaust process stream by applying the flow rate, the process stream temperature and pressure and the exhaust stream temperature and pressure to the enthalpy data. Such controller is also programmed to compute twice a difference between the inlet enthalpy and the exhaust enthalpy and a square root thereof, and the setpoint for the speed of the rotor by multiplying the operational efficiency parameter of the turboexpander by the square root and dividing the product by pi multiplied by the diameter of the impeller.

In either aspect of the present invention, the generator can be a permanent magnet generator directly coupled to the impeller of the turboexpander and the speed of the rotor of the generator and the electrical power is controlled by a variable frequency drive for the permanent magnet generator that can be provided with an input for the setpoint. The use of a permanent magnet generator is particularly advantageous in that it eliminates need for induced or separately excited rotor winding currents and the losses inherent therein. Moreover, the use of a direct coupled generator is also advantageous in that it eliminates the transmission between the turboexpander and generator that in itself produces irreversible loss.

Furthermore, the process can be an air separation process or the apparatus can be a cryogenic air separation plant and as such, the process stream is composed of compressed and purified air. The process stream is compressed in a booster compressor to produce the compressed process stream and the compressed process stream is at least partially cooled within a main heat exchanger of the air separation plant or in other words, at least to a temperature between the warm and cold ends of the main heat exchanger. After having been at least partially cooled, the compressed process stream is introduced into the turboexpander and the refrigeration is imparted into the process by introducing the exhaust stream into at least one of a high pressure column and a low pressure column used in the cryogenic air separation plant to distill the air into oxygen-rich and nitrogen-rich components. The compressed and purified air can be cooled within the main heat exchanger such that exhaust stream is in a liquid state.

BRIEF DESCRIPTION OF THE DRAWINGS

While the specification concludes with claims distinctly pointing out the subject matter that Applicants regard as their invention, it is believed that the invention will be understood with reference to the following accompanying drawings in which:

DETAILED DESCRIPTION

Figure 1:
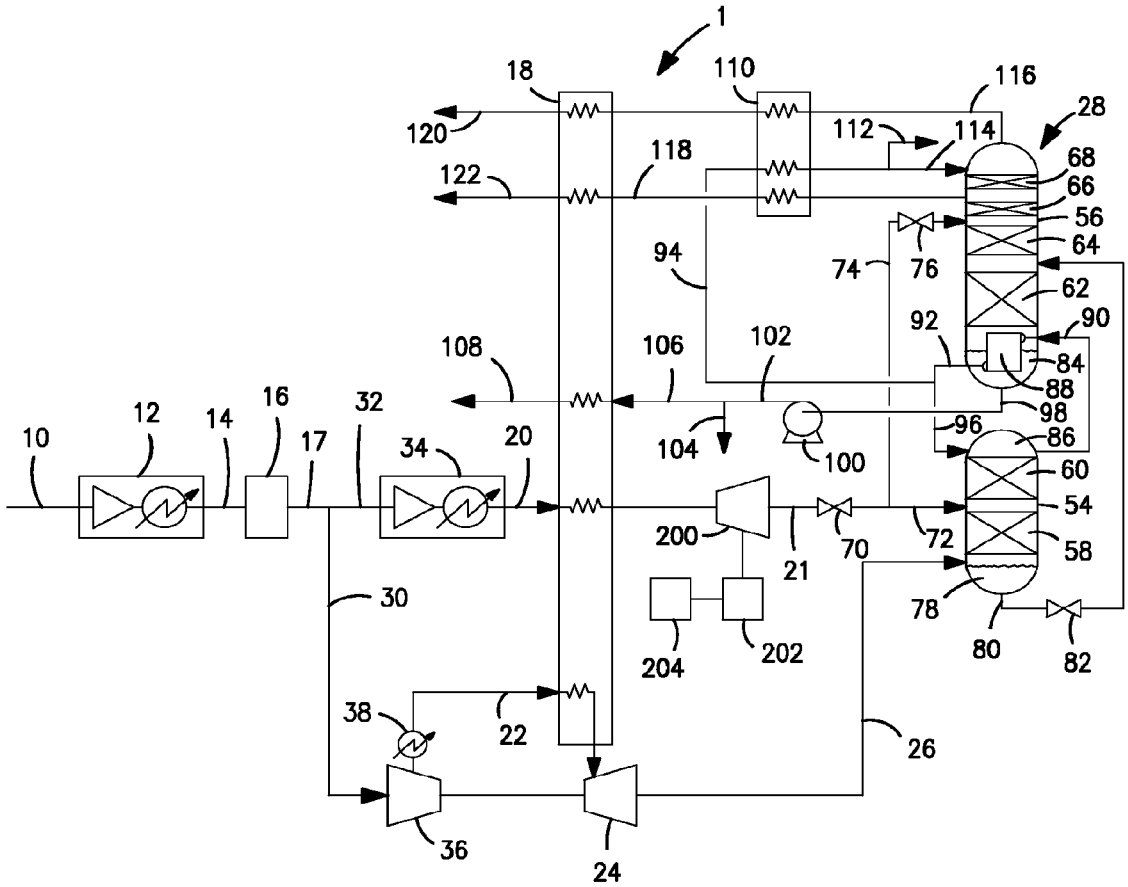
FIG. 1 is a schematic process flow diagram of an air separation plant that incorporates the present invention.

With reference to FIG. 1, an air separation plant 1 is illustrated that incorporates a refrigeration system that includes a liquid turboexpander 200 coupled to a generator 202 that is controlled in accordance with the present invention as will be discussed in greater detail below. It is understood, however, this is for exemplary purposes to the extent that the subject invention has broader applicability to other types of processes and apparatus that operate at sub-ambient temperatures, for example liquefiers.

In air separation plant 1, a feed stream 10 containing oxygen and nitrogen, for instance air, is separated by a known cryogenic rectification process to produce gaseous and liquid oxygen products as well as gaseous nitrogen and liquid products.

Feed stream 10 is compressed within a base load compressor 12 that may be an intercooled, integral gear compressor with condensate removal. The resultant compressed feed stream 14, is then purified within a prepurification unit 16. Prepurification unit 16 is well known in the art typically contains beds of alumina and/or molecular sieve operated in accordance with the temperature and/or pressure swing adsorption cycle in which higher boiling impurities are adsorbed. As known in the art, such higher boiling impurities are typically, carbon dioxide, water vapor and hydrocarbons. While one bed is operating, another bed is regenerated. Other processes could be used such as direct contact water cooling, refrigeration based chilling, direct contact with chilled water and phase separation.

A main heat exchanger 18 is in flow communication with the base load compressor 12. Main heat exchanger 18 is configured such that a first compressed stream 20 is cooled within the main heat exchanger 18 and a second compressed stream 22 is partially cooled within the main heat exchanger 18. First compressed stream 20 and second compressed stream 22 are made up of the compressed feed stream 14. In case of air, as discussed above, the compressed stream 14 is purified by prepurification unit 16. It is understood, that main heat exchanger 18, although illustrated as a single unit, could in reality be two units in which a separate product boiler is provided for boiling liquid oxygen. Additionally, the main heat exchanger 18 could be further split into sections at the warm and cold ends thereof. As such, the term "main heat exchanger" as used herein and in the claims encompasses both a single unit and a system of heat exchangers as well known in the art. Brazed fin aluminum heat exchangers could be used. However, other possible designs known in the art could also be used.

As will be discussed, apparatus 1 is designed to produce a pressurized oxygen stream that will be vaporized within the main heat exchanger. As such, first and second compressed streams 20 and 22 are formed by dividing compressed and purified feed stream 17, discharged from the prepurification unit 16, into a first part 30 and a remaining part 32. First part 30 of compressed stream 17 is compressed by a booster compressor 36. After removal of the heat of compression by an after cooler 38 the resultant second compressed stream 22 is withdrawn from the main heat exchanger 18 in a partially cooled state, and is introduced into turboexpander 24 to produce a major portion of the refrigeration requirements of air separation plant 1. In this particular application of the present invention, however, the control system thereof is not applied to turboexpander 24, but rather the liquid turboexpander 200, to be discussed, that supplies additional refrigeration. In the illustrated embodiment, turboexpander 24 is coupled so as to booster compressor 34. There are process cycles for air separation plants in which a turboexpander expanding a gas to be introduced into distillation columns is connected to a generator to produce electricity and the present invention would have applicability to such an expander. The second part 32 of the compressed feed stream 17 is compressed by a product boiler compressor 34 that again, can be an integral gear compressor with condensate removal between stages.

Distillation column system 28 has a higher pressure column 54 and a lower pressure column 56. Higher pressure column 54 is provided with mass transfer contacting elements 58 and 60 and lower pressure column 56 is provided with mass transfer contacting elements 62, 64, 66 and 68. Higher pressure column 54 and lower pressure column 56 are so named in that higher pressure column 54 operates at a higher pressure than the lower pressure column 56. The mass transfer contacting elements 58 through 68 can preferably be structured packing or other known elements such as dump packing or sieve trays or combinations thereof. However, in both such columns, liquid and vapor phases of the mixture contained in feed stream 10 are contacted within such elements and an ascending vapor phase is produced that becomes ever more rich in the nitrogen and a liquid phase descends that becomes ever more rich in the oxygen. In the illustrated embodiment, the turbine exhaust stream 26 is introduced into the base of higher pressure column 54 to initiate the formation of the ascending vapor phase.

First compressed stream 20, being at a much higher pressure than either of the higher pressure column 54 and the lower pressure column 56, and sub-cooled after going through a main heat exchanger 18, is expanded to a higher pressure column pressure by way of a liquid turboexpander 200 coupled to a variable speed generator 202 that is controlled by a control system 204 to be discussed in more detail hereinafter and controlled in accordance with the present invention. The resulting exhaust stream 21 is used to impart refrigeration as a liquid stream that is expanded to the pressure of the higher pressure column 54 by way of an expansion valve 70 and divided into a first portion 72 that is introduced into the higher pressure column 54 and rectified, and second portion 74 that is expanded again in an expansion valve 76 to a pressure suitable for its introduction into lower pressure column 56 where such stream is also rectified. It is to be noted that there are plant designs in which all of the liquid air is expanded and either introduced into the higher pressure column or the lower pressure column.

Within higher pressure column 54, the distillation produces a crude liquid oxygen column bottoms 78. A stream 80 of the crude liquid oxygen column bottoms 78 is expanded in an expansion valve 82 and then introduced into lower pressure column 56 for further refinement. Within lower pressure column 56, an oxygen-rich liquid 84 collects as a column bottoms. Additionally, at the top portion of the higher pressure column 54, a nitrogen-rich vapor 86 collects. Higher pressure column and lower pressure column 54 and 56 are linked via a condenser reboiler 88. A stream of the nitrogen-rich vapor 90 that has collected within higher pressure column 54 is introduced into condenser reboiler 88 to produce a nitrogen enriched liquid stream 92. One part 94 of nitrogen-rich liquid stream 92 is at least in part introduced into the top of lower pressure column 56 as reflux to initiate the formation of the descending liquid phase. Similarly, the other part 96 of nitrogen-rich liquid stream 92 is introduced into the top of higher pressure column 54 to initiate the formation of the descending liquid phase.

An oxygen-rich liquid stream 98 is withdrawn from the bottom of the lower pressure column 56 and consists of the residual oxygen-rich liquid that is not vaporized by condenser reboiler 88. This oxygen-rich liquid stream is pumped by a pump 100 to produce a pumped liquid oxygen stream 102. A part 104 of pumped liquid oxygen stream 102 forms the liquid oxygen product stream. A remaining part 106 vaporized within the main heat exchanger 18 to produce a gaseous oxygen product stream 108. The vaporization is effectuated by the remaining part 32 of compressed feed stream 17 that has been recompressed within product boiler compressor 34. As such, first compressed stream 20 will be liquefied upon such vaporization.

The one part 94 of nitrogen-rich liquid stream is passed through a subcooling unit 110 and one portion 112 thereof can also be taken as a liquid product and a remaining portion 114 can be introduced into the top of lower pressure column 68 as reflux. Subcooling is accomplished by passing a gaseous nitrogen product stream 116 and a waste nitrogen stream 118 in indirect heat exchange with the one part 94 of nitrogen-rich liquid stream 92. This produces a warmed gaseous nitrogen stream 120 and a fully warmed waste nitrogen stream 122.

As indicated above, the present invention is applied to air separation plant 1 in connection with the liquid turboexpander 200. Liquid turboexpander 200 is a centrifugal type of expander having inlet guide vanes, also known in the art as nozzles, that can be selectively positioned. Although not part of the invention, the nozzles would be set to control the flow rate through the turbine because such flow rate impacts the liquid level in the main heat exchanger of an air separation plant or the liquefier heat exchanger for the liquid turbine in a liquefier. For example, since the heat exchanger is upstream of the liquid turbine, if the nozzles are opened, more flow is allowed to flow out of the heat exchanger, lowering the liquid level in the heat exchanger. The opposite is true if the nozzles are closed. It is important to control the liquid level in the heat exchanger because it impacts the temperatures of the other process streams that are exchanging heat with the liquid turbine flow stream. This can be done automatically or through feed back control.

Figure 2:
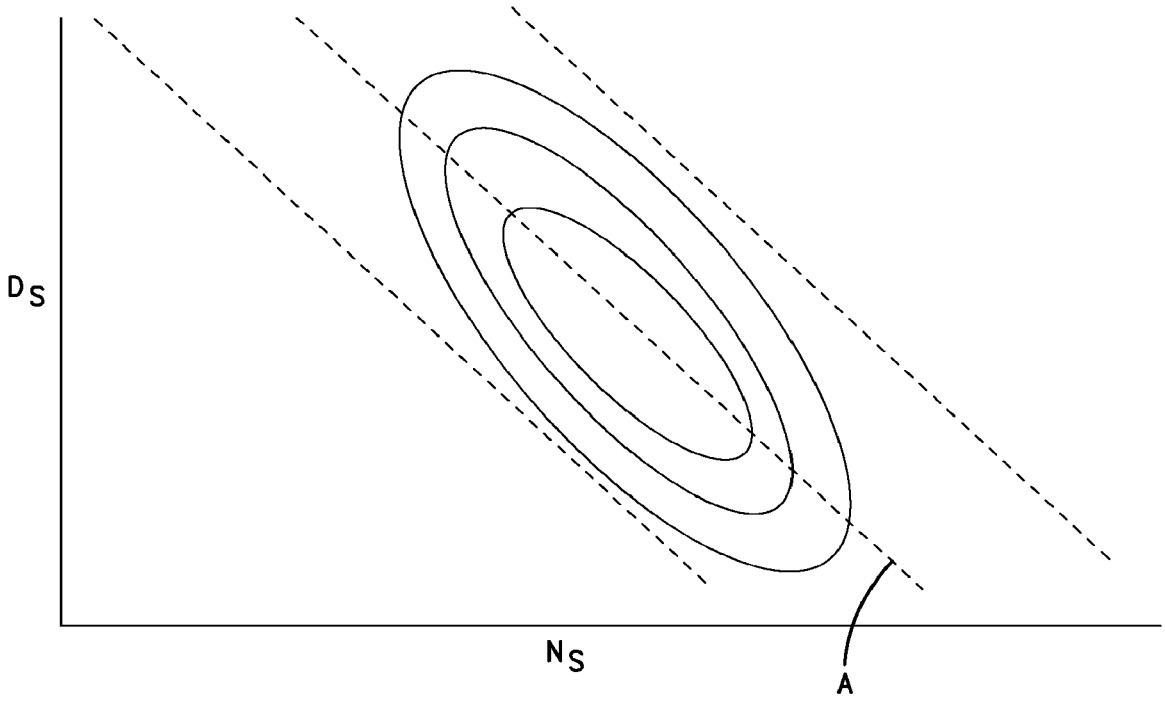
FIG. 2 is an efficiency map of a liquid turboexpander used in the air separation plant illustrated in FIG. 1.

Liquid turboexpander 200, as in any type of rotating equipment, has an efficiency that is related to the degree to which power is able to be transmitted to an output shaft or other device connected to an impeller thereof given the total energy of the flow serving as an input to liquid turboexpander 200 less the energy of the energy of its exhaust stream 21. With reference to FIG. 2, such efficiency can be mapped and presented in graphical form. In the graph, "$D_s$" is a specific diameter that is non-dimensional and is equal to a product of the actual diameter of the turbine and enthalpy drop of the flow through liquid turboexpander 200 raised to the $\frac{1}{4}^{th}$ power divided by the square root of the volumetric flow. "$N_s$" is the specific speed and is again a non-dimensional factor equal to a product of the actual speed of the impeller of the liquid turboexpander 200 and the square root of the volumetric flow through the liquid turboexpander 200 divided again by the enthalpy loss raised to the $\frac{1}{4}^{th}$ power. The solid lines are the efficiency line of the isentropic efficiency of the liquid turboexpander 200. Each of the solid lines bounds areas of ever increasing efficiency moving towards the center of the graph. The dashed lines are lines of constant $U/C_o$. $U/C_o$ is given by the equation: $U/Co=(pi\times N\times D)/(2\times\Delta h)^{0.5}$; where "pi"=3.14 etc., "N" is the speed of the impeller of, for example, the liquid turboexpander 200, "D" is the diameter of the impeller employed in liquid turboexpander 200 and "Δh" is the drop in enthalpy as measured between the first compressed stream 20 upon entry into the liquid turboexpander 200 and the exhaust stream 21 upon discharge from the liquid turboexpander 200. As is apparent, if dashed line "A" is selected for the operation of liquid turboexpander 200, then such line of operation will always encompass the maximum isentropic efficiency of liquid turboexpander 200. In this regard, dashed line "A" has an optimal value that is selected to centrally pass through an optimal efficiency region or in other words the innermost efficiency line for the greatest range of specific speed. In accordance with the present invention, the speed of the generator 202 is controlled to in turn control the speed of the liquid turboexpander 200 by electromagnetic braking of the rotor of the generator 202 so that $U/C_o$ is always driven to an efficient value or 0.75 upon varying conditions of the flow of first compressed stream 20 and exhaust stream 21. This is done by solving the aforesaid equation for the speed "N" and such speed is impressed on the operation of a generator controller (to be discussed) that is used in connection with generator 202 and that has provision for setting a setpoint for the speed of the generator 202.

Figure 3:
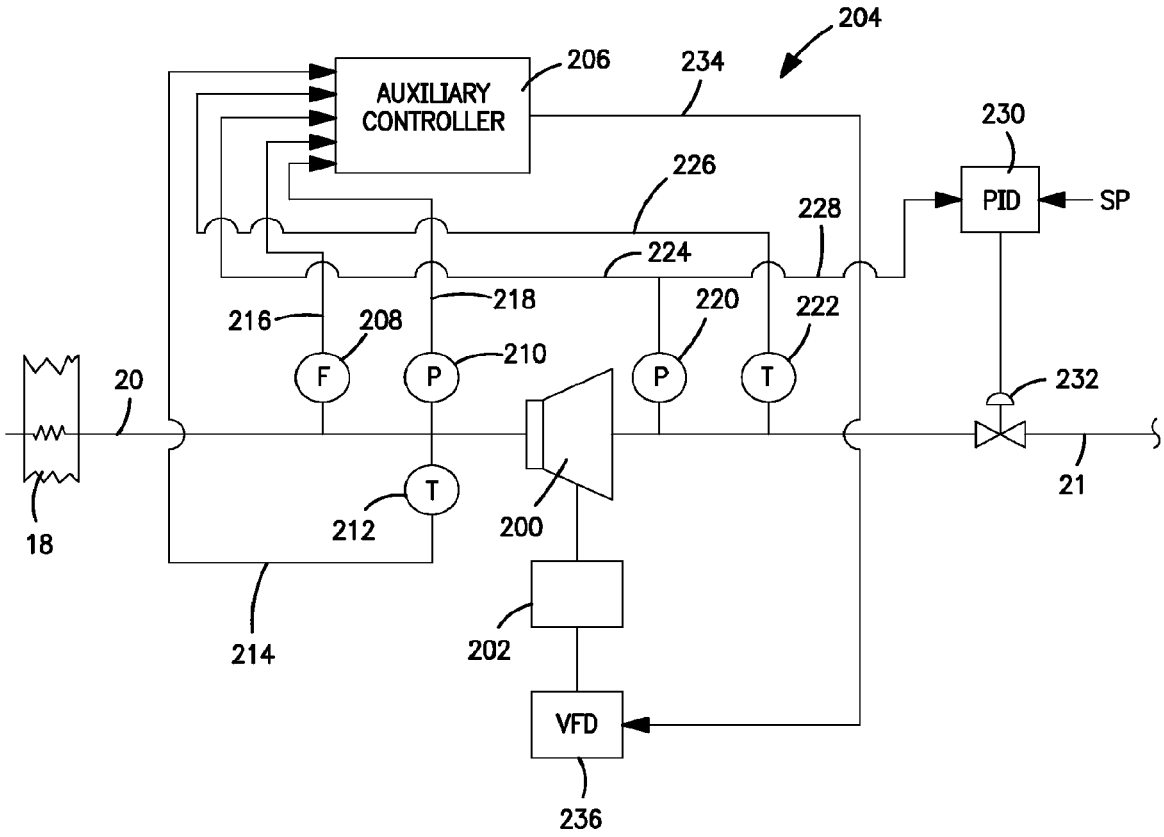
FIG. 3 is a fragmentary, schematic diagram of a control system that is used in connection with a high speed generator coupled to the turboexpander employed in FIG. 1.

With reference to FIG. 3, the control system 204 is illustrated. Control system 204 incorporates an auxiliary controller 206 that uses the algorithm to compute a speed "N" based upon a preset value of $U/C_o$ that represents a maximum operating efficiency based upon a map of turboexpander performance shown in FIG. 2 in which the desired operational speed "N" of the liquid turboexpander 200 is computed on the basis of $((U/Co)*(2\times\Delta h)^{0.5})/(pi\times D)$. The "Δh" term that represents the drop in the enthalpy between first compressed stream 20 and exhuast stream 21 is computed by measuring the flow, pressure and temperature of first compressed stream 20 upstream of liquid turboexpander 200 by flow transducer 208, pressure transducer 210 and temperature transducer 212, respectively. Signals referable to the flow, pressure and temperature that can be digital in format are inputed into auxiliary controller 206 as indicated by data transmission lines 214, 216 and 218. Downstream of the liquid turboexpander 200, the pressure and temperature of exhust stream 21 is measured by pressure and temperature transducers 220 and 222, respectively. Signals referable to such pressure and temperature are also inputted into auxiliary controller 206 by way of data transmission lines 224 and 226. The data inputted into auxiliary controller is then applied to an enthalpy data base preprogrammed into auxilary controller 206 and the outlet enthalpy of exhaust stream 21 is subtracted from the inlet enthalpy of first compressed stream 20 to determine "Δh". The auxiliary controller then computes the speed by the equation mentioned above, the $U/C_o$ and the "D" having been programmed into auxiliary controller 206. It is to be noted here that although conventional and not part of the invention, a signal from pressure transducer 220 is transmitted via data transmission line 228 to proportional, integral and differential controller 230 having a setpoint "SP" of pressure for backpressure valve 232. Controller 230 reacts to the pressure measured by pressure transducer 220 to back pressure liquid turboexpander 220 and thus, set the pressure of exhaust stream 21. As can be appreciated, auxiliary controller 206 could be a personal computer or like device programed to carry out the calculations discussed above.

An output signal 234 referable to the speed computed by auxiliary controller 206 is inputted into the variable frequency drive 236 ("VFD") of generator 202 as a setpoint for the speed of the generator 202. The variable frequency drive 236, acts as a speed controller for generator 202, is then updated with the current setpoint or speed calculated by auxiliary controller 206 and to the extent the speed of the liquid turboexpander 200 is below or above such setpoint, the generator 202 will brake by electromagnetic braking to a lessor or greater extent, respectively, the rotor of generator 202 and therefore, the impeller of liquid turboexpander 200.

Figure 4:
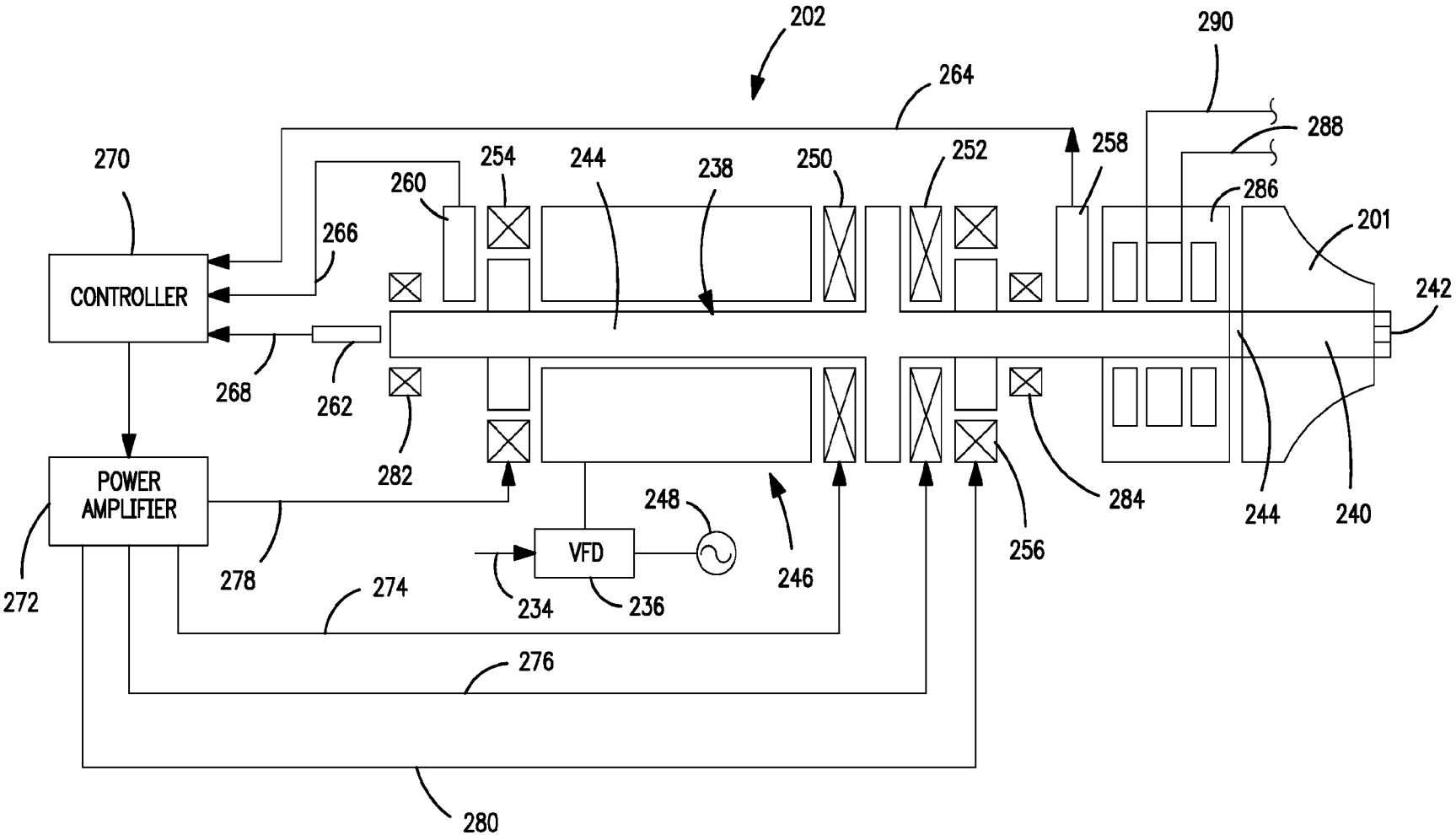
FIG. 4 is a fragmentary, schematic diagram of the high speed generator and turboexpander employed in FIG. 1.

With reference to FIG. 4, the connection between an impeller 201 of the liquid turboexpander 200 to the rotor 238 of generator 202 is illustrated. Generator 202 is preferably a permanent magnet motor having magnetic bearings. The importance of this is that oil-free bearings prevent irreversible losses due to heat dissipation that would otherwise occur with oil lubricated bearings. Generator 202 incorporates the variable frequency drive 236, discussed above, in which a setpoint for the speed can be set; which in accordance with the present invention is the speed computed by auxiliary controller 206. When used as a generator, the variable speed drive 236 also has another function, namely to maintain the voltage and frequency of the power output at a preset level. In this regard, variable frequency drive 236 consists of three basic components used to match the variable speed generator to the fixed frequency utility grid: the rectifier section, the DC link and the inverter section. By modifying the switching pattern in the inverter section of the drive, the level of power flow from the DC link to the utility is controlled so that the output voltage and frequency can be maintained at the level necessary to supply the power to the grid. In this regard, the voltage is maintained slightly above power grid levels and the frequency is maintained at a level equal to that of the line frequency of the power grid, for example, 60 HERTZ. By controlling power flow, current through the DC link and in the generator stator windings is controlled which in turn controls the counter-torque applied by the generator rotor to the turboexpander and therefore the speed of the rotor. The speed of the liquid turboexpander 200 is thus controlled by the variable efficient conversion of mechanical speed and torque into electrical power.

The impeller 201 is attached to the rotor 238 by means of a threaded tiebolt 240 and a lock nut 242. A rigid coupling 244 such as a HIRTH coupling minimizes the contribution of axial assembly to rotor imbalance.

The rotor 238 houses permanent magnets 244, that due to the rotation of rotor 238, generates an electric current within a fixed stator assembly 246 surrounding the rotor 238. The variable speed drive 236 in a manner outlined above, generates the electrical output 248 from the electric current induced within fixed stator assembly 246 in the manner outlined above.

Rotor 238 is supported by magnetic bearings that consist of thrust bearings 250 and 252 in the axial direction and radial bearings 254 and 256 in the radial direction. Shaft displacement sensors 258, 260 and 262 measure movement of the rotor 238. Output signals, transmitted by electrical connections 264, 266 and 268 from the shaft displacement sensors 258, 260 and 262, respectively, are transmitted to a digital controller 270 to compute output currents that are generated in power amplifier 272 that are applied through electrical connections 274 and 276 to thrust bearings 250 and 252, respectively and electrical connections 278 and 280 to radial bearings 254 and 256, respectively. The magnitude of the output currents is thus varied by digital controller 270 to maintain the rotor 238 in a stable radial and axial orientation and with a minimum of displacement. Upon a power failure, secondary mechanical bearings 282 and 284 support the rotor 238. In addition to the foregoing, a dry face seal 286 prevents the leakage of liquid air to the bearings and the stator assembly 246 that have been discussed above. The dry face seal 286 is conventional and high pressure gas from line 288 and low pressure gas from line 290 is supplied to the dry face seal 286. The high pressure seal gas is supplied at a pressure higher than that of the inlet pressure of first compressed air stream 20 to liquid turboexpander 200 to prevent leakage of the liquid air. The low pressure seal gas is at a lower pressure and serves to ensure that any seal gas leakage to the rotor 238 and the stator assembly 246 is at low pressure.

The generator 202 and the variable frequency drive 236 are available from a variety of manufacturers. It is to be noted, however, that the present invention also has application to an alternating current induction generator or any other type of motor or that could be used as a generator. In case of an alternating current induction generator, the coupling to the turboexpander could be made by a geared transmission. In such case known electronic circuitry would be used to effect the electromagnetic braking and the control of voltage and frequency to be maintained at line matching levels of the electric power grid. However, this would be disadvantageous in that their would be inherent power losses in such a generator and thermo-mechanical losses in the transmission used in connection with such a generator.

While the present invention has been described with reference to a preferred embodiment, as will occur to those skilled in the art, numerous changes, additions and omissions can be made without departing from the scope of the present invention as set forth in the appended claims.

We claim:

1. A method of generating refrigeration in a process operating at sub-ambient temperatures, said method comprising:

compressing a process stream utilized within the process to produce a compressed process stream;

expanding the compressed process stream within a turboexpander having an impeller that is driven by the process stream with performance of work, thereby producing an exhaust stream;

the turboexpander designed to operate at an operational efficiency parameter equal to optimal value of $U/C_o$;

introducing the exhaust stream into the process to impart the refrigeration into the process;

generating electrical power with a generator having a rotor coupled to the impeller so that the generator is driven by the work of expansion;

controlling speed of the rotor of the generator and therefore, the turboexpander through electromagnetic braking of the rotor such that the speed is maintained at a setpoint and electrical current output of the generator increases as the speed of the rotor decreases and decreases as the speed of the rotor increases;

controlling voltage and frequency of the electrical power generated by the generator as to be maintained at line matching levels and the electrical power generated by the generator may be introduced into a local electrical power grid at the line matching levels; and continually determining the setpoint of the speed of the rotor and therefore, the turboexpander by setting the setpoint equal to the product of the operational efficiency parameter and a square root of twice the difference between enthalpies of the compressed process stream upon entry into the turboexpander and the exhaust stream upon discharge from the turboexpander, divided by a product of pi and a diameter of the impeller.

2. The method of claim 1, wherein the generator is a permanent magnet generator directly coupled to the impeller and the speed of the rotor of the generator and the electrical power is controlled by a variable frequency drive for the permanent magnet generator having an input for the setpoint.

3. The method of claim 2, wherein the difference between enthalpies of the compressed process stream and the exhaust stream is determined by:

providing enthalpy data for the compressed process stream based upon pressure and temperature of the compressed process stream;

measuring a flow rate of the compressed process stream;

measuring a process stream temperature and pressure of the compressed process stream and determining an inlet enthalpy from the enthalpy data, the flow rate and the compressed process stream temperature and pressure;

measuring an exhaust stream temperature and pressure of the exhaust stream and determining an exhaust enthalpy of the exhaust stream from the enthalpy data, the flow rate, the exhaust stream temperature and pressure; and subtracting the exhaust enthalpy from the inlet enthalpy.

4. The method of claim 3, wherein:

the flow rate is measured with a flow transducer generating a flow rate signal referable to the flow rate;

the compressed process stream temperature and pressure and the exhaust stream temperature and pressure are measured with temperature sensors and pressure transducers generating temperature and pressure signals referable to the compressed process stream temperature and pressure and the exhaust stream temperature and pressure;

an auxiliary controller, responsive to the flow rate signal, the temperature and pressure signals and pre-programmed with the enthalpy data in a database, is configured to determine the inlet enthalpy, the exhaust enthalpy, the difference between the enthalpy of the process inlet stream and the exhaust stream and the square root thereof of twice the difference, divide said square root by pi and the impeller diameter to calculate the setpoint of the speed of the rotor.

5. The method of claim 1 or claim 4, wherein:

the process is a cryogenic air separation plant;

the process stream is composed of compressed and purified air;

the process stream is compressed in a booster compressor to produce the compressed process stream;

the compressed process stream is at least partially cooled within a main heat exchanger of the air separation plant;

the compressed process stream after having been at least partially cooled is introduced into the turboexpander; and refrigeration is imparted to the process by introducing the exhaust stream into at least one of a high pressure column and a low pressure column used in the cryogenic air separation plant to distill the air into oxygen-rich and nitrogen-rich components.

6. The method of claim 5, wherein the compressed and purified air is cooled within the main heat exchanger and the exhaust stream is in a liquid state.

7. A refrigeration generation system in an apparatus operating at sub-ambient temperature, said refrigeration generation system comprising:

a turboexpander having an impeller that is driven by a process stream compressed within the apparatus such that the compressed process stream is expanded with the performance of work and an exhaust stream is thereby produced by the turboexpander;

the turboexpander designed to operate at an operational efficiency parameter equal to optimal value of $U/C_o$;

the turboexpander connected to the apparatus such that the process stream is introduced into the turboexpander and the exhaust stream is introduced into the apparatus to impart the refrigeration into the apparatus;

a generator to generate electrical power, the generator having a rotor coupled to the impeller so that the generator is driven by the work of expansion;

a generator controller connected to the generator and configured to control the speed of the rotor of the generator and therefore, the turboexpander through electromagnetic braking of the rotor such that the speed is maintained at a setpoint and electrical current output of the generator increases as the speed of the rotor decreases and decreases as the speed of the rotor increases and to control voltage and frequency of the electrical power generated by the generator such that the voltage and the frequency is maintained at line matching levels to enable the electrical power generated by the generator to be introduced into a local electrical power grid at the line matching levels;

a flow transducer positioned upstream of the turboexpander so as to generate a flow rate signal referable to a flow rate of the compressed process stream;

an upstream pair of temperature sensors and pressure transducers positioned upstream of the turboexpander so as to generate process stream temperature and pressure signals referable to the process stream temperature and pressure of the process stream;

a downstream pair of temperature and pressure transducers positioned downstream of the turboexpander so as to generate exhaust stream temperature and pressure signals referable to exhaust stream temperature and pressure of the exhaust stream; and an auxiliary controller connected to the generator controller, responsive to the flow rate signal, the process stream and the exhaust stream temperature and pressure signals and containing enthalpy data of the process stream in a database;

the auxiliary controller programmed to continually determine an inlet enthalpy of the compressed process stream and an exhaust stream enthalpy of the exhaust process stream by applying the flow rate, the process stream temperature and pressure and the exhaust stream temperature and pressure to the enthalpy data, to compute twice a difference between the inlet enthalpy and the exhaust enthalpy and a square root thereof, and the setpoint for the speed of the rotor by multiplying the operational efficiency parameter of the turboexpander by the square root and dividing the product by pi multiplied by the diameter of the impeller.

8. The refrigeration generation system claim 7, wherein the generator is a permanent magnet generator directly coupled to the impeller and the generator controller is a variable frequency drive for the permanent magnet generator.

9. The refrigeration generating system of claim 7 or claim 8, wherein:

the apparatus is a cryogenic air separation plant;

the process stream is composed of compressed and purified air;

the process stream is compressed in a booster compressor to produce the compressed process stream;

the compressed process stream is at least partially cooled within a main heat exchanger of the air separation plant;

the compressed process stream after having been at least partially cooled is introduced into the turboexpander; and refrigeration is imparted to the apparatus by introducing the exhaust stream into at least one of a high pressure column and a low pressure column used in the cryogenic air separation plant to distill the air into oxygen and nitrogen-rich components.

10. The refrigeration generating system of claim 9, wherein the compressed and purified air is cooled within the main heat exchanger and the exhaust stream is in a liquid state.

* * * * *